US007325492B2

(12) United States Patent
Kobayashi

(10) Patent No.: US 7,325,492 B2
(45) Date of Patent: Feb. 5, 2008

(54) STENCIL PRINTER

(75) Inventor: Kazuyoshi Kobayashi, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 361 days.

(21) Appl. No.: 11/067,761

(22) Filed: Mar. 1, 2005

(65) Prior Publication Data

US 2005/0200692 A1 Sep. 15, 2005

(30) Foreign Application Priority Data

Mar. 3, 2004 (JP) ..... 2004-058987

(51) Int. Cl.
*B41L 13/14* (2006.01)

(52) U.S. Cl. ..... 101/116; 101/128.4

(58) Field of Classification Search ..... 101/114, 101/116, 128.4, 129
See application file for complete search history.

(56) References Cited

U.S. PATENT DOCUMENTS 7,073,436 B2 * 7/2006 Takahashi ..... 101/229

2003/0127001 A1 * 7/2003 Kanno ..... 101/116

FOREIGN PATENT DOCUMENTS

JP 2003-200645 7/2003

* cited by examiner

*Primary Examiner*—Ren Yan
(74) *Attorney, Agent, or Firm*—Oblon, Spivak, McClelland, Maier & Neustadt, P.C.

(57) ABSTRACT

A stencil printer of the present invention includes a print drum and a pressing member selectively movable into or out of contact with the print drum. A duplex master, formed with a first and a second image in the lengthwise direction thereof, or a simplex master formed with a third image is wrapped around the print drum in a duplex mode or a simplex mode, respectively. The stencil printer is capable of selectively performing a duplex print mode operation, which consists of a front printing step and a rear pining step following the front printing step, or a simplex print mode operation. When the operator of the printer selects the duplex print mode to cause the duplex master to be wrapped around the print drum and then replaces the duplex print mode with the simplex print mode, the stencil printer produces an alarm and inhibits the simplex pint mode operation from being started.

1 Claim, 6 Drawing Sheets

STENCIL PRINTER

BACKGROUND OF THE INVENTION

1. Field of the Invention

The present invention relates to stencil printer and more particularly to a stencil printer capable of selectively operable in a simplex print mode using a simplex master or a duplex pint mode using duplex master.

2. Description of the Background Art

Digital thermosensitive stencil printing, which is well known in the art as a simple printing method, uses a stencil printer including a thermal head having an array of heating elements arranged thereon. While the thermal head is in contact with a stencil being conveyed, current is selectively fed to the heating elements in the form of pulses for thereby selectively perforating, or cutting, the stencil with in accordance with image data. After the perforated stencil, or master as referred to hereinafter, has been wrapped around a porous, cylindrical print drum, a press roller or similar pressing means presses the print drum via a sheet. Consequently, ink is transferred to the sheet via the perforations of the master and form an image on the sheet.

A current trend in the stencil printers art is toward duplex prints carrying images on both surfaces thereof and therefore saving, e.g., sheets and a space necessary for the storage of documents. It has been customary to produce a duplex copy by feeding a sheet from a sheet feeding section to a printing section to thereby print an image on one surface of the sheet, reversing and again feeding the sheet to the printing section to thereby print an image on the other side of the same sheet. Such a procedure, however, forces the operator to again set sheets once discharged and neatly arrange sheets each carrying an image on one surface thereof by hand. Another problem with the conventional duplex printing is that it needs two times longer net period of time than simplex printing because a single sheet must be passed via the printing section two times.

In light of the above, Japanese Patent Laid-Open Publication No. 2003-200645 discloses a duplex printer using a duplex print formed with a first and a second image arranged in the direction of rotation of a print drum. In the duplex printer taught in this document, after one of the first and second images has been formed on a first sheet fed from a sheet feeder, the first sheet is guided to an auxiliary tray. After one of the images of the duplex master has been formed on a second sheet also fed from the sheet feeder, the second sheet is also guided to the auxiliary tray. At the same time, the first sheet is again fed from the auxiliary sheet to the printing section, so that the other image is formed on the reverse surface of the sheet. The first sheet is then discharged as a duplex copy. Such a procedure is repeated to produce duplex prints by a single step.

However, the duplex printer taught in the above document prints an image on one surface of a sheet and then prints an image on the other surface of the same sheet. This brings about a problem that when an image is to be printed on the other surface of a sheet, which carries an image on one surface, ink is transferred from the one surface to pressing means and then transferred to one surface of the next sheet (so-called offset).

To cope with offset, pressing means my be provided with a fine, irregular surface configured to allow ink to deposit on the surface little. However, the pressing means contacts a master wrapped around the print drum when a smaller sheet size is selected after a master has been made, when, after a master for duplex printing has been made, simplex printing is effected with sheets smaller in size than the master or when, after master making, the print drum is replaced with a new print drum loaded with a simplex or a duplex master greater in size than sheets to be used. In any case, ink fed from the inside of the print drum is directly transferred to the surface of the pressing means. It is extremely difficult to remove ink filled gaps between fine projections present on the surface of the pressing means.

SUMMARY OF THE INVENTION

It is an object of the present invention to provide a single-step duplex printer capable of producing attractive prints by preventing pressing means from directly contacting a print drum or a master wrapped thereon.

A stencil printer of the present invention includes a print drum and a pressing member selectively movable into or out of contact with the print drum. A duplex master, formed with a first and a second image in the lengthwise direction thereof, or a simplex master formed with a third image is wrapped around the print drum in a duplex mode or a simplex mode, respectively. The stencil printer is capable of selectively performing a duplex print mode operation, which consists of a front printing step and a rear pining step following the front printing step, or a simplex print mode operation. When the operator of the printer selects the duplex print mode to cause the duplex master to be wrapped around the print drum and then replaces the duplex print mode with the simplex print mode, the stencil printer produces an alarm and inhibits the simplex pint mode operation from being started.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
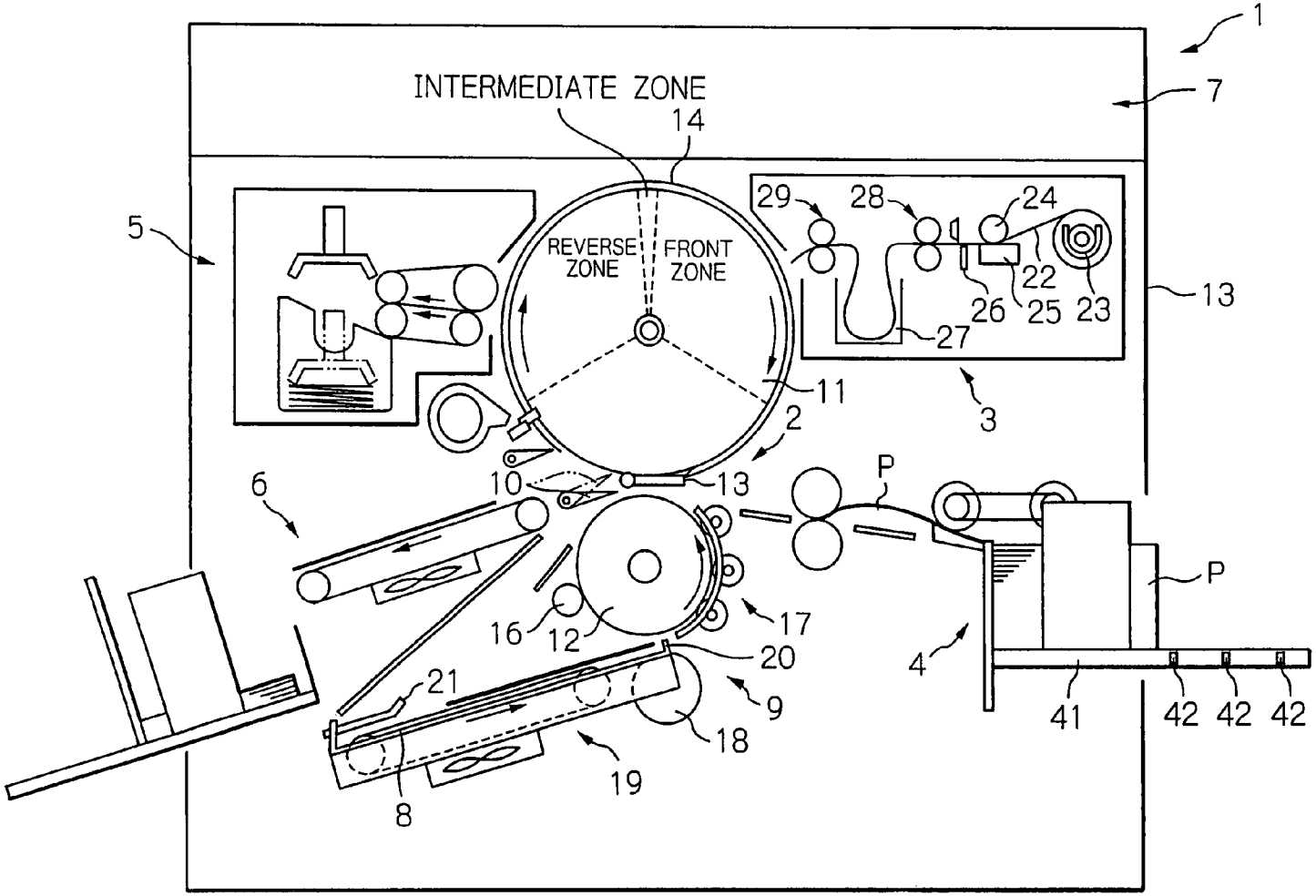
FIG. 1 is a front view showing the general construction of a stencil printer to which a first to a ninth embodiment of the present invention is applied.

Referring to FIG. 1 of the drawings, a stencil printer to which the present invention is applied is shown. Because the stencil printer shown in FIG. 1 has substantially the same configuration as a duplex printer disclosed in Japanese Patent Laid-Open Publication No. 2003-200645 mentioned earlier, various sections included in the stencil printer will be described as briefly as possible.

As shown in FIG. 1, the stencil printer, generally 1, includes a printer body 43, a printing section 2, a master making section 3, a sheet feeding section 4, a master discharging section 5, a sheet discharging section 6, an image scanning section 7, an auxiliary tray 8, sheet refeeding means 9, and a path selector or switching member 10.

The printing section 2 is positioned at substantially the center of the printer body 43 and includes a print drum 11 and a press roller or pressing means 12. The print drum 11 is removably, rotatably mounted on the printer body 43 and caused to rotate by drum drive means not shown. A damper 13 is mounted on the circumferential surface of the print drum 11 in such a manner as to be openable away from the drum surface. A duplex master 14 or a simplex master 15 made by the master making section 3 is wrapped around the print drum 11 in a duplex print mode or a simplex print mode, respectively, as will be described more specifically later. A rotary encoder, not shown, adjoins the circumferential surfaced of the print drum 11 in order to sense the angular position of the print drum 11. In accordance with the present invention, the maximum size of the simplex master that can be wrapped around the print drum 11 corresponds to the sheet size of A3.

Figure 2:
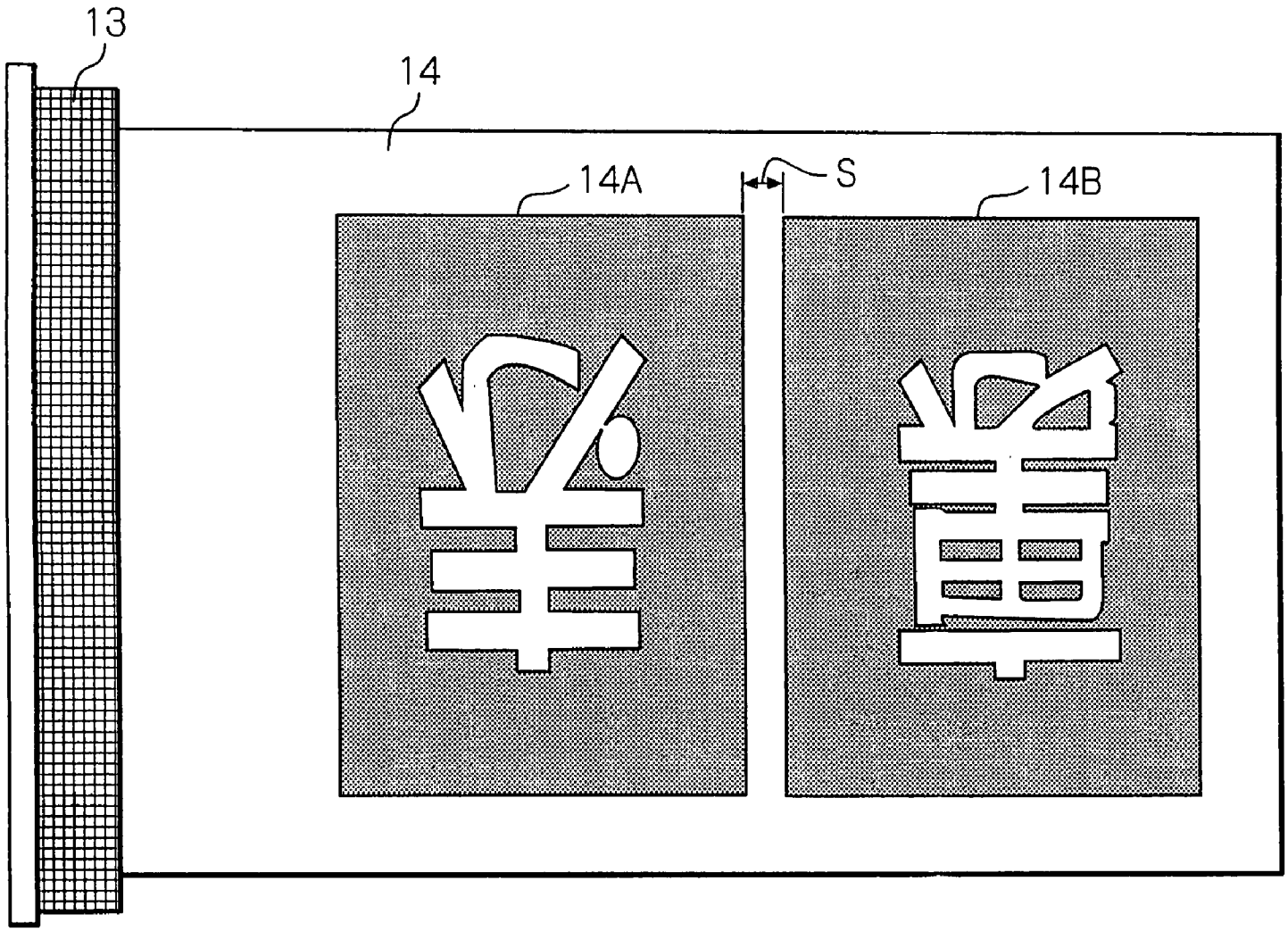
FIG. 2 shows a specific duplex master applicable to the first to ninth embodiments.

FIG. 2 shows a specific duplex master 14 formed with a first and a second image 14A and 14B corresponding to a front image and a reverse image, respectively, and divided from each other by a boundary or non-perforated portion S. As shown in FIG. 1, the duplex master 14 is wrapped around the print drum 11 such that the first and second images 14A and 14B and boundary portion S are positioned in a front zone, a reverse zone and an intermediate zone, respectively. In accordance with the present invention, the maximum size of each of the two images 14A and 14B corresponds to the sheet size of A4 held in a portrait position as distinguished from a landscape position.

Figure 3:
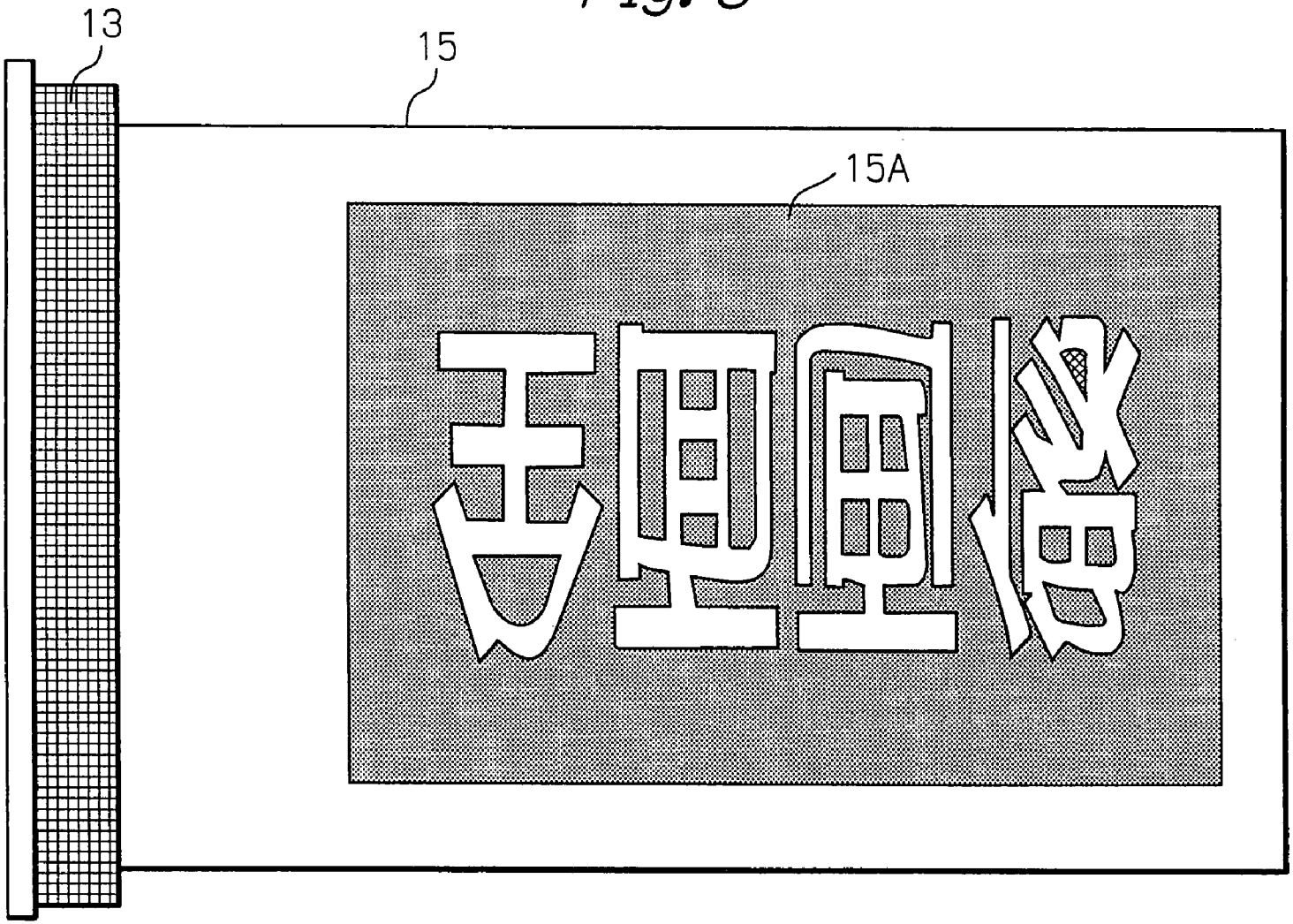
FIG. 3 shows a specific simplex master applicable to the first to eighth embodiments.

FIG. 3 shows a specific simplex master 15 formed with a third image or simplex image 15A. The simplex master 15 is wrapped around the print drum 11 over the total range of the font zone, reverse zone and intermediate zone shown in FIG. 1. In accordance with the present invention, the maximum size of the third image 15A corresponds to the sheet size of A3.

Figure 4:
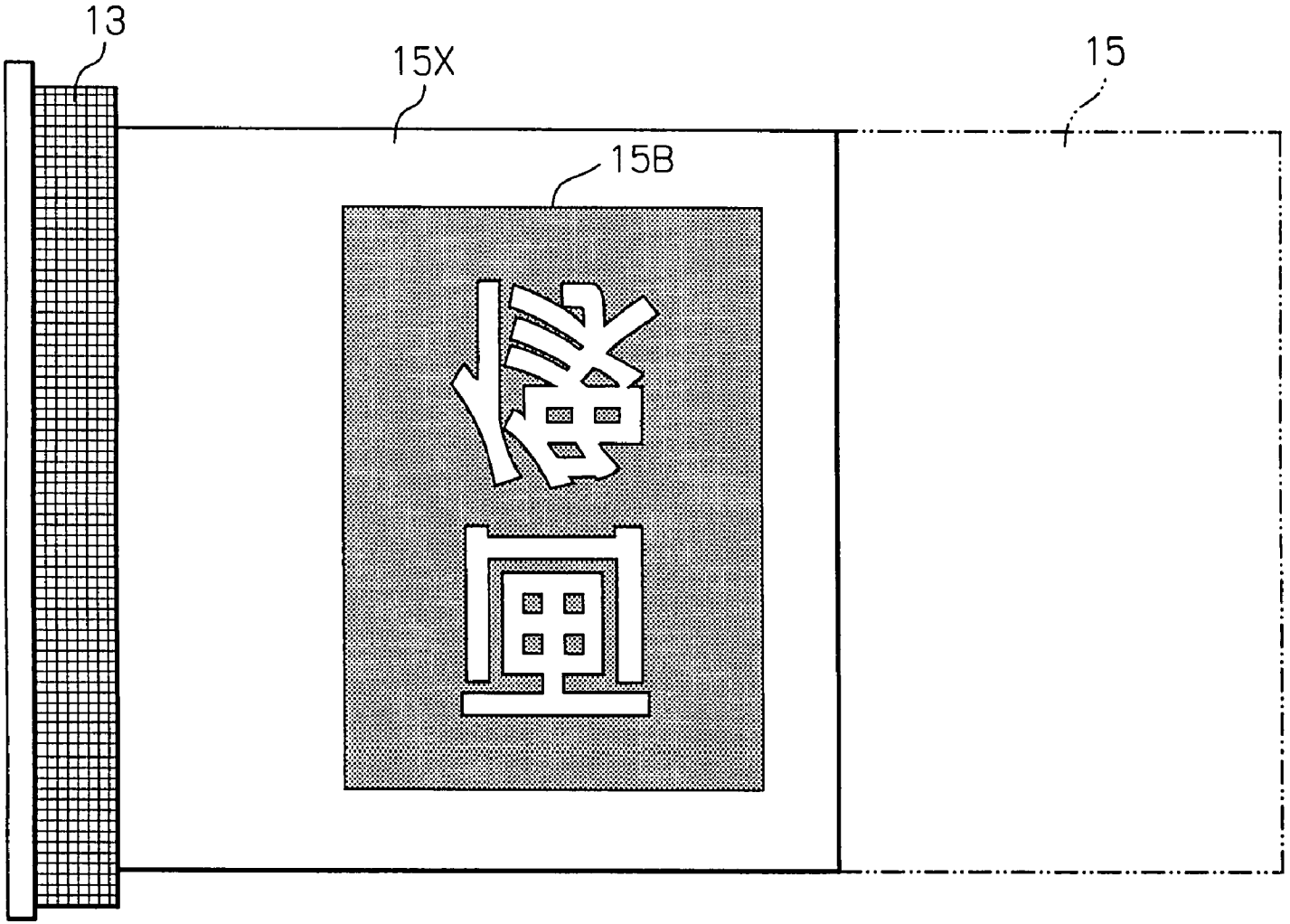
FIG. 4 shows a specific cut mode master applicable to the ninth embodiment.

In accordance with the present invention, the stencil printer 1 is additionally operable in a master cut mode that will be described specifically later. FIG. 4 shows a specific master 15X formed with a third image 15B in the master cut mode. As shown, the size of the third image 15B is limited to the size of the front zone shown in FIG. 1, i.e., a length substantially one-half of the usual length. In accordance with the present invention, the maximum size of this third image 15B corresponds to the sheet size of A4 held in the landscape position.

Referring again to FIG. 1, the press roller 12 is positioned below the print drum 11 and formed of fluorocarbon resin or similar elastic, water-repellent material. The press roller 12 is rotatably supported by a pair of arms, not shown, at axially opposite ends thereof while the arms are angulary movably supported by moving means not shown. The press roller 12 is therefore movable between a non-contact position where it is spaced from the print drum 11 and a contact position where it is pressed against the pint drum 11.

The moving means selectively presses the press roller 12 against the print drum 11 over a first range containing all of the front zone, intermediate zone and reverse zone shown in FIG. 1, a second range coincident with the front zone or a third range containing the downstream portion of the front zone in the direction of rotation of the print drum 11, intermediate zone and reverse zone. A cleaning roller 16 adjoins the press roller 12 and is rotated by drive means, not shown, to clean the circumferential surface of the press roller 12 in contact therewith.

A refeed guide member 17 is located adjacent to and at the right-hand side of the press roller 12 and configured to convey a sheet P carrying an image on its front surface along the circumferential surface of the press roller 12. A reefed registration roller 18 is positioned below the press roller 12 in order to pay out the sheet P from the auxiliary tray 8 while causing it to contact the press roller 12. The auxiliary tray 8 is mounted on the top of a reefed conveying unit 19 arranged left below the press roller 12 while a reefed positioning member 20 is constructed integrally with the reefed conveying unit 19. A flat sheet receiver 21 is positioned above the reefed conveying unit 19 and freely movable along the upper surface of the auxiliary tray 8. The auxiliary tray 8, reefed guide member 17, refeed registration roller 18, refeed positioning member 20, refeed conveying unit 19 and sheet receiver 21 constitute the refeeding means 9 in combination.

The path selector 10 is positioned on a sheet path at the left-hand side of the position where the press roller 12 is expected to contact the print drum 11. The path selector 10 has its downstream edge, as seen in the direction of sheet conveyance, pivotally supported by the printer body 4 and is selectively moved by shifting means, not shown, to a first position indicated by a solid line in FIG. 1 or a second position indicated by a dash-and-dots line by a phantom line in FIG. 1. The path selector 10 guides, when held in the first position, the sheet P conveyed via the nip between the print drum 11 and the press roller 12 toward the sheet discharge section 6 or guides it toward the auxiliary tray 8 when held in the second position.

The master making section 3 is arranged at the above right the printing section 2 and provided with a conventional configuration including a stencil holding member 23, a platen roller 24, a thermal head 25, stencil cutting means 26, a stencil stocking portion 27, a tension roller pair 28 and a turn roller pair 29. The stencil holding member 23 holds a stencil 22 implemented as a roll. The master making section 3 makes the duplex master 14 in the duplex print mode, makes the simplex master 15 in the simplex print mode or makes the master or cut-mode master 15X in the master cut mode.

The sheet feeding section 4 is located below the master making section 3 and also has a conventional configuration including a sheet tray 41 loaded with a stack of sheets P, a pickup roller, a reverse roller, a separation pad and a registration roller par. A plurality of sheet size sensors 42 are mounted on the sheet tray 41 for sensing the size of the sheets P stacked on the sheet tray 41.

The master discharging section 5 arranged at the above left of the printing section 2 has a conventional configuration including an upper and a lower master discharging member, a waste master box and a compressing plate. The master discharging section 5 peels off any one of the duplex master 14, simplex master 15 and cut-mode master 15X wrapped around the print drum 11 and collects it in the waster master box.

The sheet discharging section 6 is located below the master discharging section 5 and has a conventional configuration including a peeler, a sheet discharge conveying unit, a print tray and a separation fan. The sheet discharging section 6 peels off the sheet or print P from the surface of the print drum 11 and discharges it to the print tray.

The image scanning section 7, mounted on the top of the printer body 43, includes a glass platen on which a document is to be laid, a cover plate movable into and out of contact with the glass platen, a light source and mirrors for scanning the document and a lens for focusing imagewise light reflected from the document on an image sensor, although not shown specifically.

Figure 5:
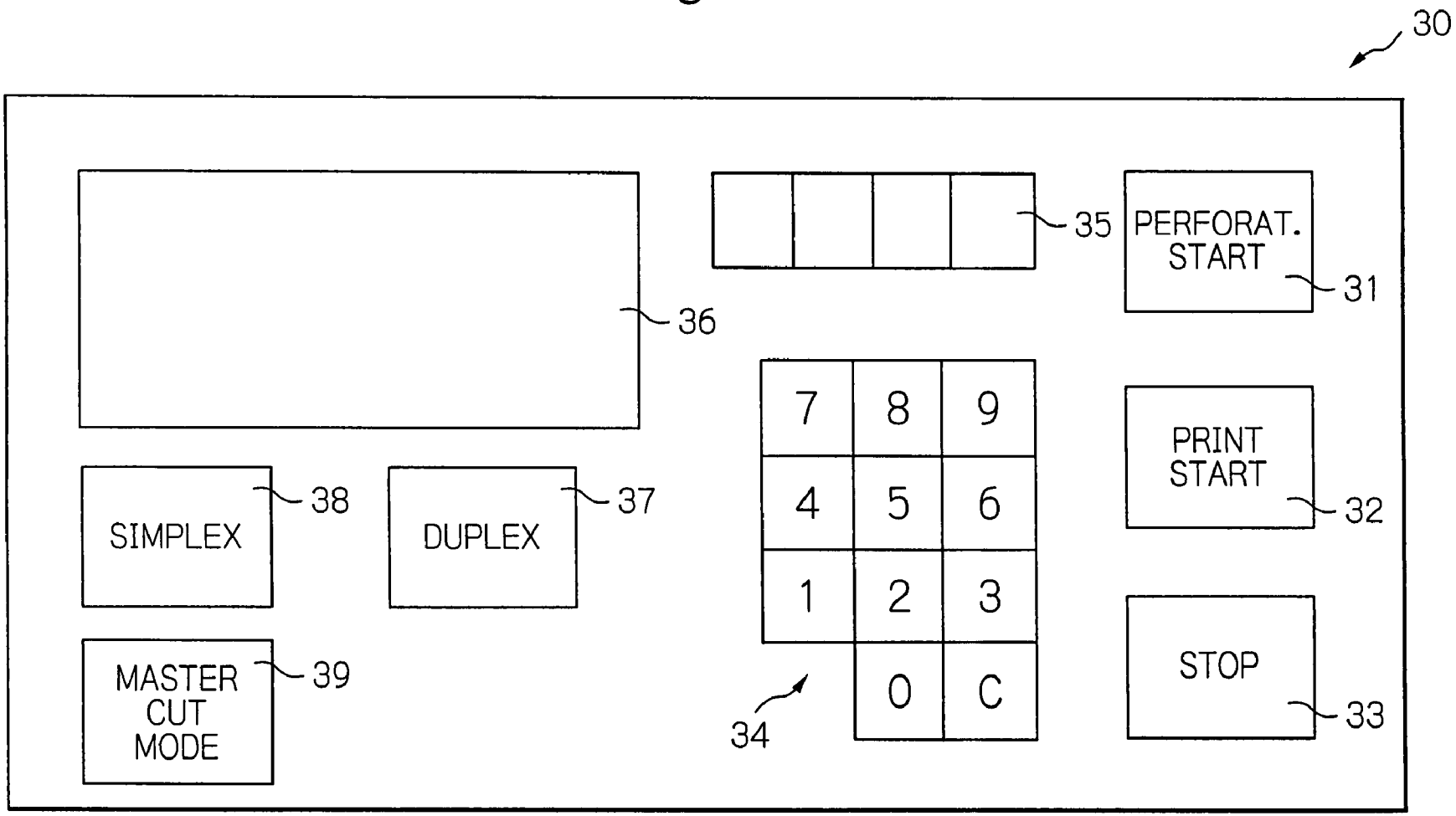
FIG. 5 shows a specific arrangement of a control panel applicable to the first to ninth embodiments.

FIG. 5 shows a control panel 30 mounted on the stencil printer 1. As shown, the control panel 30 includes a cut, or perforation, start key 31, a print start key 32, ten keys 34, an indicator 35 implemented by seven-segment LEDs (Light Emitting Diodes) and an LCD (Liquid Crystal Display) panel 36 as conventional. In addition, the control panel 30 includes a duplex print key 37 to be pressed for selecting the duplex print mode, a simplex print key 38 to be pressed for selecting the simplex print mode and a master cut mode key 39 to be pressed for selecting the master cut mode.

Figure 6:
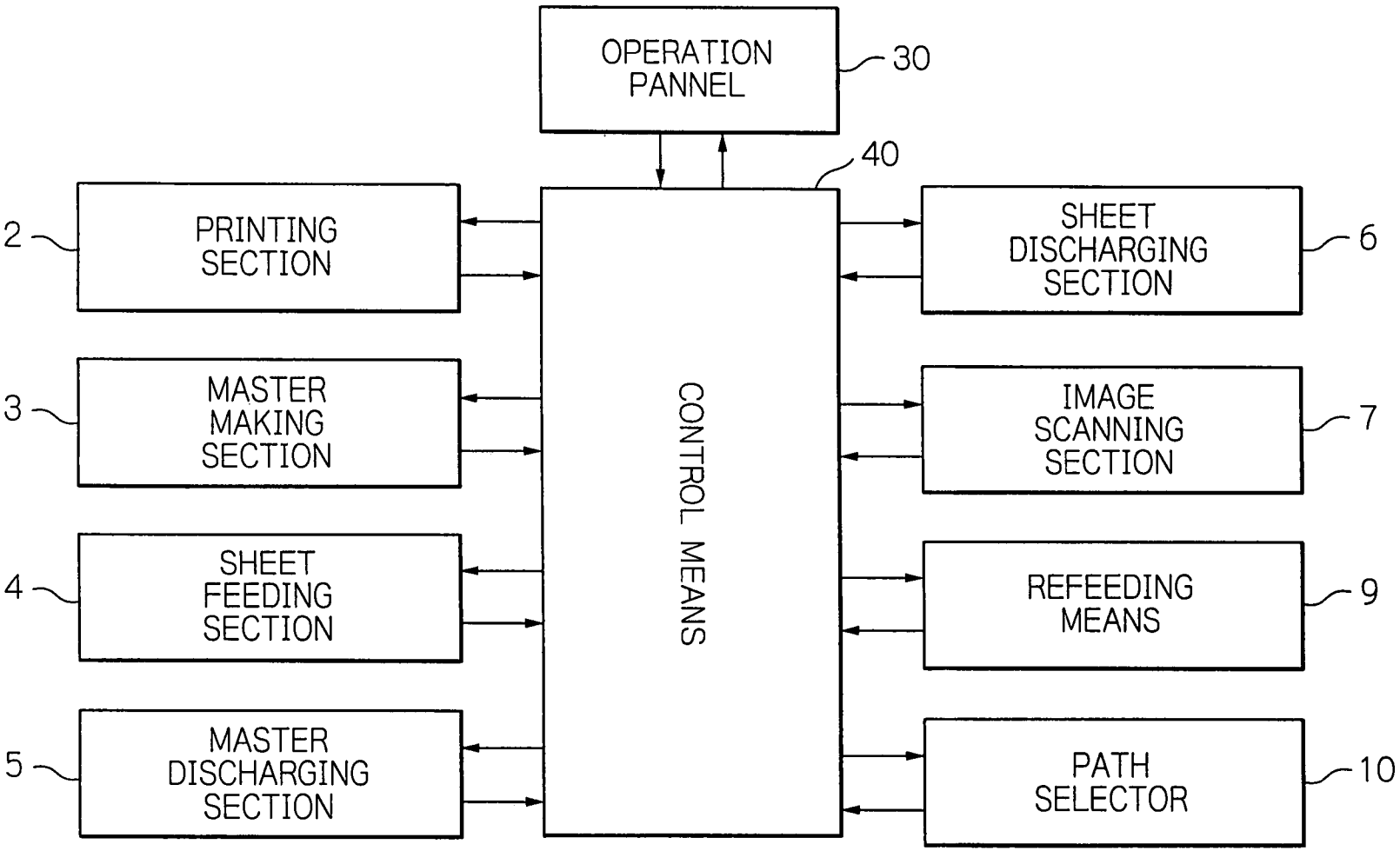
FIG. 6 is a schematic block diagram showing a control system applicable to the first to ninth embodiments.

FIG. 6 shows a control system included in the stencil printer 1. As shown, the control system includes control means 40 implemented as a microcomputer including a CPU (Central Processing Unit), a ROM (Read Only Memory) and a RAM (Random Access Memory). The control means 40 controls the operations of the printing section 2, master making section 3, sheet feeding section 4, master discharging section 5, sheet discharging section 6, image scanning section 7, refeeding means 9 and path selector 10 in accordance with the output signal of the rotary encoder and signals output from the operation panel 30. The control means 40 is capable of storing the sizes of the images 14A and 14B formed in the duplex master 14.

A duplex print mode operation to be executed when the operator of the stencil printer 1 presses the duplex print key 37 will be described hereinafter.

When the operator lays desired documents on the glass platen of the image scanning section 7 and then presses the duplex print key 37, the control means 40 memorizes the selection of the duplex print mode and calls a duplex print operation program. Subsequently, when the operator presses the cut start key 31, the image scanning section 7 scans the documents while the master discharging section 5 peels off a used master, which may be simplex or duplex, wrapped around the print drum 11. Thereafter, the master making section 3 forms the first and second images 14A and 14B in the stencil 22 to thereby produce a new duplex master 14. The new duplex master 14 is then wrapped around the print drum 11.

After the new duplex master 14 has been fully wrapped around the print drum 11, the stencil printer 1 remains in a stand-by condition. In this condition, when the operator, selected various printing conditions, presses the print start key 32, the print drum 11 is caused to rotate at a preselected speed while a single sheet P is fed from the sheet feeding section 4, stopped by the registration roller pair and again driven toward a gap between the print drum 11 and the press drum 12 at preselected timing. The operator may select desired printing conditions before pressing the cut start key 31, if desired.

As soon as the print drum 11 is rotated by a preselected angle to a position where its front zone faces the press roller 12, the press roller 12 is brought into pressing contact with the print drum 11 with the result that the sheet P is pressed against the first image 14A of the duplex master 14A wrapped around the print drum 11. As a result, the first image 14A is transferred from the master 14A to one surface or front surface of the sheet P. At this instant, the moving means for moving the press roller 12 is caused to press the press roller 12 against the print drum 11 over the second range stated previously.

The sheet P, carrying the first image 14A on the front surface thereof, is peeled off from the drum 11 by the edge of the path selector 10, which is held in the second position, and steered toward the refeed conveying unit 19 thereby. At this instant, the leading edge of the sheet P is received by the sheet receiver 21, so that the sheet P is laid on the auxiliary tray 8 with the trailing edge at the head. The refeed conveying unit 19 conveys the above sheet P in a direction indicated by an arrow in FIG. 1. The sheet P is then brought to a stop with its leading edge abutting against the positioning member 20.

The print drum 11 is continuously rotated even when the first sheet P is being guided onto the auxiliary tray 8. In this condition, the second sheet P is fed from the sheet feeding section 4 at the same timing as the first sheet P was fed. At this time, the moving means has selected the first range over which the press roller 12 should be pressed against the print drum 11. The second sheet P, like the first sheet P, is pressed against the print drum 11 by the press roller 12 with the result that first image 14A is transferred to the front surface of the sheet P. The second sheet, carrying the first image 14A, is also steered by the path selector 10 held in the second position toward the refeed conveying unit 19.

After the second sheet P has been fed from the sheet feeding section 4, but slightly before the reverse zone of the print drum 11 reaches a position where it faces the press roller 12, the refeed registration roller 18 is driven to press the first sheet P present on the auxiliary tray 8 against the press roller 12. The press roller 12, being rotated by the print drum 11 in pressing contact therewith, conveys the first sheet P toward the nip between the press roller 12 and the print drum 11. Consequently, the other or reverse surface of the first sheet P is pressed against the duplex master 14, so that the second image 14B is transferred from the duplex master 14 to the above surface of the sheet P.

The first sheet or duplex print P, thus carrying images on both surfaces thereof, is steered by the path selector 10, which is held in the first position this time, toward the sheet discharging section 6, raised by air sent from the separation fan, and then peeled off from the print drum by the edge of the peeler. The sheet P is then conveyed to the sheet discharging section and driven out to the print tray thereby. The procedure described so far is repeated with a desired number of sheets. After the last sheet P has been brought to the auxiliary tray 8, the moving means selects the third range over which the press roller 12 should be pressed against the print drum 11. When a desired number of duplex prints are fully output, the various sections of the stencil printer 1 are caused to stop operating.

Next, a simplex or usual print mode operation to be executed when the operator of the stencil printer 1 presses the simplex print key 38 will be described hereinafter.

When the operator lays a desired document on the glass platen of the image scanning section 7 and then presses the simplex print key 38, the control means 40 memorizes the selection of the simplex print mode and calls a simplex print operation program. Subsequently, when the operator presses the cut start key 31, the image scanning section 7 scans the document while the master discharging section S peels off a used master, which may be simplex or duplex, wrapped around the print drum 11. Thereafter, the master making section 3 forms the third image 15A in the stencil 22 to thereby produce a new simplex master 15. The new duplex master 15 is then wrapped around the print drum 11.

After the new simplex master 15 has been fully wrapped around the print drum 11, the stencil printer 1 again remains in the stand-by condition. In this condition, when the operator, selected various printing conditions, presses the print start key 32, the print drum 11 is caused to rotate at the preselected speed while a single sheet P is fed from the sheet feeding section 4, stopped by the registration roller pair and again driven toward the gap between the print drum 11 and the press drum 12 at preselected timing.

As soon as the print drum 11 is rotated by the preselected angle to the position where its front zone faces the press roller 12, the press roller 12 is brought into pressing contact with the print drum 11 with the result that the sheet P is pressed against the third image 15A of the simplex master 14A wrapped around the print drum 11. As a result, the third image 14A is transferred from the master 15 to the sheet P. At this instant, the moving means for moving the press roller 12 is caused to press the press roller 12 against the print drum 11 over the first range stated previously.

The sheet or simplex print P, thus carrying an image on one surface thereof, is steered by the path selector 10 held in the first position toward the sheet discharging section 6, raised by air sent from the separation fan, and then peeled off from the print drum by the edge of the peeler. The sheet P is then conveyed to the sheet discharging unit and driven out to the print tray thereby. The procedure described so far is also repeated with a desired number of sheets. After the last sheet P has been brought to the auxiliary tray 8, the moving means selects the third range over which the press roller 12 should be pressed against the print drum 11. When a desired number of simplex prints are fully output, the various sections of the stencil printer 1 are caused to stop operating.

Hereinafter will be described an alternative simplex print mode operation to be executed in the master cut mode.

When the operator lays a desired document on the glass platen of the image scanning section 7 and then presses the simplex print key 38, the control means 40 memorizes the selection of the simplex print mode and calls the simplex print operation program. Subsequently, when the operator presses the master cut mode key 39, the control means 40 replaces the simplex print operation program with a master cut mode operation program.

Subsequently, when the operator presses the perforation start key 31, the image scanning section 7 scans the document while the master discharging section 5 peels off a used master wrapped around the print drum 11. This is followed by the master making operation. At this instant, if the size of the document and that of the sheets P to be used do not exceed the maximum size available with the master cut mode, the stencil 22 is perforated in the master cut mode; if otherwise, the stencil printer 1 stops operating while displaying an adequate message on the LCD panel 36.

In the master cut mode, the cut mode master 15X shown in FIG. 4 specifically is made and then wrapped around the print drum 11. Subsequently, while the stencil printer 1 is wailing in the simplex print mode, the operator input various printing conditions and then presses the print start key 32. In response, the print drum is caused to rotate at the preselected speed while a single sheet P is fed from the sheet feeding section 4, stopped by the registration roller pair and again driven toward the gap between the print drum 11 and the press drum 12 at preselected timing.

As soon as the print drum 11 is rotated by the preselected angle to the position where its front zone faces the press roller 12, the press roller 12 is brought into pressing contact with the print drum 11 with the result that the sheet P is pressed against the third image 15B of the cut mode master 15X wrapped around the print drum 11. As a result, the third image 15B is transferred from the master 15X to the sheet P. At this instant, the moving means for moving the press roller 12 is caused to press the press roller 12 against the print drum 11 over the second range stated previously.

The sheet or print P, thus carrying an image on one surface thereof, is steered by the path selector 10 held in the first position toward the sheet discharging section 6, raised by air sent from the separation fan, and then peeled off from the print drum by the edge of the peeler. The sheet P is then conveyed to the sheet discharging unit and driven out to the print tray thereby. The procedure described so far is also repeated with a desired number of sheets. After the last sheet P has been brought to the auxiliary tray 8, the moving means selects the third range over which the press roller 12 should be pressed against the print drum 11. When a desired number of simplex prints are fully output, the various sections of the stencil printer 1 are caused to stop operating.

Preferred embodiments of the present invention practicable with the stencil printer 1 stated above will be described hereinafter.

In a first embodiment, assume that the operator presses the duplex print key 37, then presses the perforation start key 31, then presses, just after the stencil printer 1 has entered the stand-by condition in the duplex print mode with the duplex master 14 wrapped around the print drum 11, the simplex print key 38 instead of the print start key 32 and then presses the print start key 32. Then, the control means 40 inhibits the printing operation in the simplex print mode from being started while displaying "Master for duplex printing is wrapped. Choose duplex printing or choose perforation again." or similar alarm message on the LCD panel 36.

With the above configuration, the illustrative embodiment achieves the following advantage. Assume that the sheets P to be used are of A4 portrait size, B5 size or similar size smaller than the total size of the images 14A and 14B formed in the duplex master 14, e.g., A3 size. Then, the illustrative embodiment obviates an occurrence that the press roller 12 directly presses part of the perforated portion of the master 14 not covered with the sheet P and is therefore smeared with ink. The alarm message, appearing on the LCD panel 36, is canceled when the operator again selects the duplex print mode on the duplex print key 37 or presses the perforation start key 31 without canceling the simplex print mode, in which case the master discharging operation and master making operation will be repeated.

In a second embodiment, assume that the operator presses the duplex print key 37, then presses the perforation start key 31, then presses, just after the stencil printer 1 has entered the stand-by condition in the duplex print mode with the duplex master 14 wrapped around the print drum 11, the simplex print key 38 instead of the print start key 32 and then presses the print start key 32. Then, the control means 40 determines the size of the sheets P stacked on the sheet tray 41 on the basis of the outputs of the sheet size sensors 42, calls the sizes of the images 14A and 14B stored beforehand, and then compares smaller one of the sizes of the images 14A and 14B and the size of the sheets P. If the size of the sheets P is smaller than the smaller one of the sizes of the images 14A and 14B, then the control means 40 displays "Inadequate sheet size. Change sheets." or similar alarm message on the LCD panel 36 and inhibits the simplex print mode operation from being started.

With the above configuration, the illustrative embodiment achieves the following advantage. Assume that the sheets P to be used are of B5 size or similar size smaller than smaller one of the sizes of the images 14A and 14B formed in the duplex master 14, e.g., A4 size. Then, the illustrative embodiment obviates an occurrence that the press roller 12 directly presses part of the perforated portion of the master 14 not covered with the sheet P and is consequently-smeared with ink. The alarm message, appearing on the LCD panel 36, is canceled when the operator again selects the duplex print mode on the duplex print key 37 or presses the perforation start key 31 without canceling the simplex print mode to thereby cause a used master to be discharged and then causes a master matching with the sheet size to be made.

In a third embodiment, assume that the operator presses the duplex print key 37, then presses the perforation start key 31, then presses, just after the stencil printer 1 has entered the stand-by condition in the duplex print mode with the duplex master 14 wrapped around the print drum 11, the simplex print key 38 instead of the print start key 32 and then presses the print start key 32. Then, the control means 40 determines the size of the sheets P stacked on the sheet tray 41 on the basis of the outputs of the sheet size sensors 42, calls the sizes of the images 14A and 14B stored beforehand, and then compares the sizes of the images 14A and 14B and the size of the sheets P. If the size of either one of the first and second images 14A and 14B and the size of the sheets P are identical, then the control means 40 displays "Simplex printing with only front image" or similar alarm message on the LCD panel 36. This is true when the first image 14A is of the same size as the sheets P.

Watching the above alarm message, the operator presses, e.g., the print start key 32 to cancel the message by acknowledgement. When the print start key 32 is thus pressed, simplex printing is effected. At this instant, the moving means presses the press roller 12 against the print roller 11 over the second range. In this manner, when the sheets P to be used and either one of the images 14A and 14B of the duplex master 14 are of the same size, simplex printing can be effected without repeating the master making operation. This successfully promotes efficient operation and obviates the wasteful perforation of a stencil.

On the other hand, if the second image 14B of the duplex master 14 and sheets P are of the same size, then the control means 40 displays "Duplex printing with only reverse image" or similar alarm message on the LCD panel 36. In this case, in the event of simplex printing that follows the acknowledgement of the alarm message, the moving means presses the press roller 12 against the print drum 11 over the third range. Further, if the images 14A and 14B of the duplex master 14 both are of the same size as the sheets P, then the control means 40 displays "Simplex printing with front image or reverse image. Choose font or reverse." or similar message on the LCD panel 36, urging the operator to select either one of the front image 14A and reverse image 14B. Subsequently, when the operator presses the print start key 32, the above message is canceled while simplex printing with the image selected is effected.

In a fourth embodiment, assume that the operator presses the duplex print key 37, then presses the perforation start key 31, then presses, just after the stencil printer 1 has entered the stand-by condition in the duplex print mode with the duplex master 14 wrapped around the print drum 11, the simplex print key 38 instead of the print start key 32 and then presses the print start key 32. Then, the control means 40 determines the size of the sheets P stacked on the sheet tray 41 on the basis of the outputs of the sheet size sensors 42, calls the sizes of the images 14A and 14B stored beforehand, and then compares the sizes of the images 14A and 14B and the size of the sheets P. If the size of the sheets P is greater than either one of the sizes of the images 14A and 14B, then the control means 40 displays "Simplex printing with only front image" or similar alarm message on the LCD panel 36. This is true when the size of the sheets P is greater than the size of the first image 14A.

Watching the above alarm message, the operator presses, e.g., the print start key 32 to cancel the message by acknowledgement. When the print start key 32 is thus pressed, simplex printing is effected. At this instant, the moving means presses the press roller 12 against the print roller 11 over the second range. In this manner, when the size of the sheets P to be used is greater than the size of either one of the images 14A and 14B of the duplex master 14 are of the same size, simplex printing can be effected without repeating the master making operation. This successfully promotes efficient operation and obviates the wasteful perforation of a stencil.

In the fourth embodiment, if the sheets P are greater in size than the second image 14B of the duplex master 14, then the control means 40 displays "Duplex printing with only reverse image" or similar alarm message on the LCD panel 36. In this case, in the event of simplex printing that follows the acknowledgement of the alarm message, the moving means presses the press roller 12 against the print drum 11 over the third range. Further, if the sheets P are greater in size than both of the images 14A and 14B of the duplex master 14, then the control means 40 displays "Simplex printing with front image or reverse image. Choose font or reverse?" or similar message on the LCD panel 36, urging the operator to select either one of the front image 14A and reverse image 14B. Subsequently, when the operator presses the print start key 32, the above message is canceled while simplex printing with the image selected is effected.

In a fifth embodiment, assume that the operator presses the duplex print key 37, then presses the perforation start key 31, then presses, just after the stencil printer 1 has entered the stand-by condition in the duplex print mode with the duplex master 14 wrapped around the print drum 11, the simplex print key 38 instead of the print start key 32 and then presses the print start key 32. Then, the control means 40 determines the size of the sheets P stacked on the sheet tray 41 on the basis of the outputs of the sheet size sensors 42, calls the sizes of the images 14A and 14B stored beforehand, and then compares the total size of the images 14A and 14B and the size of the sheets P. If the total size of the images 14A and 14B and the size of the sheets P are identical, then the control means 40 displays "Simplex printing with front image and rear image" or similar alarm message on the LCD panel 36.

Watching the above alarm message, the operator presses, e.g., the print start key 32 to cancel the message by acknowledgement. When the print start key 32 is thus pressed, simplex printing is effected. At this instant, the moving means presses the press roller 12 against the print roller 11 over the first range. In this manner, when the size of the sheets P to be used and the total size of the images 14A and 14B are equal, simplex printing can be effected without repeating the master making operation. Although the resulting prints are not usable as duplex prints, they are usable as two simplex prints when cut off at the center or usable as folded simplex prints when folded at the center. When the total size of the images 14A and 14B and the size of the sheets P are different from each other, the illustrative embodiment operates in the same manner as the second, third or fourth embodiment.

In a sixth embodiment, assume that the operator presses the duplex print key 37, then presses the perforation start key 31, then removes, just after the stencil printer 1 has entered the stand-by condition in the duplex or the simplex print mode with the duplex master 14 or the master 15 wrapped around the print drum 11, the print drum 11 from the printer body 43, then mounts another print drum 11 to the printer body 43, and then presses the print start key 32. Then, the control means 40 displays "Print drum is replaced. Make master again." or similar alarm message on the LCD panel 36 for thereby inhibiting the duplex or the simple printing operation from being started.

The procedure stated above obviates an occurrence that when the sheets P to be used are smaller in size than the duplex master 14 or the master 15 wrapped around the print drum 11, the press roller 12 directly presses part of the perforated portion of the master 14 or 15 not covered with the sheet P and is therefore smeared with ink. The alarm message, appearing on the LCD panel 36, is canceled when the operator, mounted the print drum 11, presses the perforation start key 31 to thereby repeat master discharging operation and master making operation. If desired, only simplex printing using sheets P whose size is greater than the size of the duplex master 14 or that of the master 15, i.e., A3 size in the illustrative embodiment is allowed.

In the sixth embodiment, the replaceable print drum 11 is assumed to lack a memory with backup or similar storing means for storing information. In the case where the replaceable print drum 11 includes such storing means, printing conditions and a sheet size matching them may be stored in the storing means. This allows the duplex or the simplex printing operation to be effected only if the size of the sheets P stacked on the sheet tray 41 matches with the stored printing conditions; the sheet size is determined when the print drum 11 is mounted to the printer body 43.

In a seventh embodiment, assume that the operator sequentially presses the duplex print key 37 and perforation start key 31 and then removes, after the stencil printer 1 has entered the stands-by condition in the duplex print mode with the duplex master 14 wrapped around the print drum 11, the print drum 11 from the printer body 43. Then, the control means 40 displays "Switch to simplex printing due to replacement of print drum" or similar alarm message on the LCD panel 36, automatically replaces the stand-by condition in the duplex print mode with the sand-by condition in the simplex mode.

The procedure of the illustrative embodiment stated above obviates an occurrence that when the master 15 is wrapped around the replaced print drum 11, the press roller 12 directly presses, between the trailing edge of the preceding sheet P and the leading edge of the following sheet, part of the perforated portion of the master 15 not covered with the sheet P and is consequently smeared with ink. The alarm message is canceled when the operator, mounted the print drum 11, presses the perforation start key 31 for thereby causing master discharging operation and master making operation to be repeated. If desired, only simplex printing using sheets P whose size is greater than the size of the image of the master 15 may be allowed.

In the seventh embodiment, the replaceable print drum 11 is assumed to lack a memory with backup or similar storing means for storing information. In the case where the replaceable print drum 11 includes such storing means, printing conditions and a sheet size matching them may be stored in the storing means. This allows the stand-by condition in the duplex printing operation to be maintained only if the size of the sheets P stacked on the sheet tray 41 matches with the stored printing conditions; the sheet size is determined when the print drum 11 is mounted to the printer body 43.

In an eighth embodiment, assume that after the operator sequentially has pressed the duplex print key 37 and perforation start key 31, the stencil printer 1 has entered the stand-by condition in the duplex print mode with the duplex master 14 wrapped around the drum 11, and then the sheets P sacked on the sheet tray 41 are replaced with sheets of another size. Then, the control means 40 displays "Sheets are replaced. Make master again." or similar alarm message while inhibiting duplex printing operation from being started.

In a ninth embodiment, assume that the operator sequentially presses the simplex print key 38, master cut mode key 39 and perforation start key 31 and then presses, just after the stencil printer 1 has entered the stand-by condition in the simplex print mode with the cut mode master 15X wrapped around the print drum 11, the duplex print key 37 without pressing the print start key 32. Then, the control means 40 displays "Master for cut mode is wrapped. Choose cut-mode simplex printing or make master again." or similar message on he LCD panel 36 while inhibiting duplex printing operation from being started.

With the above procedure, the illustrative embodiment obviates an occurrence that the press roller directly presses part of the print drum 11 not covered with the cut mode maser 15X and is consequently smeared with ink. The alarm message is canceled when the operator selects cut mode printing or again presses the perforation start key 31 for causing the master discharging operation and master making operation to be repeated.

In summary, in accordance with the present invention, when sheets to be used for printing has a size smaller than the total size of two images formed in a duplex master, there can be obviated an occurrence that pressing means directly presses part of the perforated portion of the master not covered with a sheet and is consequently smeared with ink.

Various modifications will become possible for those skilled in the art after receiving the teachings of the present disclosure without departing from the scope thereof.

What is claimed is:

1. A stencil printer comprising a print drum, pressing means selectively movable into or out of contact with said print drum, and wrapping, in a duplex print mode, a duplex master formed with a first image and a second image in a lengthwise direction of said duplex master around said print drum or wrapping a simplex master formed with a third image around said print drum, said stencil printer being capable of selectively performing a duplex print mode operation, which consists of a front printing step and a rear printing step following said front printing step, or a simplex print mode operation having only one printing step, wherein a controller is provided and configured to be operated to place the stencil printer into the simplex print mode based upon an input from a simplex print mode selection input element or to be operated to place the stencil printer in the duplex print mode based upon an input from a duplex print mode selection input element, said controller being further configured to avoid conflicting print mode selection so that when, after the duplex print mode has been selected by the duplex print mode selection input element and the duplex master has been wrapped around said print drum, and said simplex print mode selection input element is operated, said stencil printer produces an alarm and inhibits the simplex print mode operation from being started.

* * * * *

UNITED STATES PATENT AND TRADEMARK OFFICE

CERTIFICATE OF CORRECTION

PATENT NO. : 7,325,492 B2
APPLICATION NO. : 11/067761
DATED : February 5, 2008
INVENTOR(S) : Kazuyoshi Kobayashi It is certified that error appears in the above-identified patent and that said Letters Patent is hereby corrected as shown below:

Column 3, line 7, please change “damper” to --clamper--.

Signed and Sealed this

Second Day of September, 2008

JON W. DUDAS
*Director of the United States Patent and Trademark Office*